US008284062B2

(12) United States Patent
Wyatt, Jr. et al.

(10) Patent No.: US 8,284,062 B2
(45) Date of Patent: Oct. 9, 2012

(54) THEFT DETERRENT DEVICE

(75) Inventors: James G. Wyatt, Jr., Weddington, NC (US); Brian V. Conti, Matthews, NC (US); Andrew W. Moock, Brecksville, OH (US); Lee H. Eckert, Waxhaw, NC (US); Lance F. Weeden, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

(21) Appl. No.: 13/154,760

(22) Filed: Jun. 7, 2011

(65) Prior Publication Data

US 2011/0234405 A1 Sep. 29, 2011

Related U.S. Application Data

(63) Continuation of application No. 12/183,631, filed on Jul. 31, 2008, now Pat. No. 7,961,100.

(60) Provisional application No. 60/963,225, filed on Aug. 3, 2007.

(51) Int. Cl.
*G08B 13/14* (2006.01)

(52) U.S. Cl. ..... 340/572.9; 340/568.1; 235/375; 705/22

(58) Field of Classification Search ..... 340/568.1, 340/571, 568.2, 572.1–572.8, 10.1; 235/375; 705/22, 28

See application file for complete search history.

(56) References Cited

U.S. PATENT DOCUMENTS

| | | | | |
|---|---|---|---|---|
| 4,772,878 | A * | 9/1988 | Kane | 340/568.4 |
| 4,774,503 | A | 9/1988 | Bussard | |
| 4,992,776 | A | 2/1991 | Crossfield | |
| 5,245,317 | A | 9/1993 | Chidley et al. | |
| 5,589,819 | A | 12/1996 | Takeda | |
| 5,745,965 | A | 5/1998 | Stoltz et al. | |
| 6,092,401 | A | 7/2000 | Sankey et al. | |
| 6,137,414 | A | 10/2000 | Federman | |
| 6,535,130 | B2 * | 3/2003 | Nguyen et al. | 340/572.9 |
| 7,098,792 | B1 | 8/2006 | Ahlf et al. | |
| 7,281,397 | B2 | 10/2007 | Victor | |
| 7,671,741 | B2 * | 3/2010 | Lax et al. | 340/572.1 |
| 2005/0229654 | A1 * | 10/2005 | Victor | 70/58 |
| 2006/0021394 | A1 | 2/2006 | Belden, Jr. | |
| 2007/0152836 | A1 * | 7/2007 | Nagelski et al. | 340/572.9 |

* cited by examiner

*Primary Examiner* — Eric M Blount

(74) *Attorney, Agent, or Firm* — Sand & Sebolt

(57) ABSTRACT

A theft deterrent device includes a carrier having a pivotally mounted pin and an alarm tag for receiving the pin to secure the carrier and alarm tag together when secured on an item of merchandise by an adhesive pad on the carrier. Spaced electrical contacts within the alarm tag receive the pin therebetween to provide an electrical path between the contacts to close a first electrical circuit which turns the device on. A flexibly mounted projection on the carrier depresses a plunger switch to arm the device when the carrier is attached to an item of merchandise. The security device is configured to sound an onboard alarm in response to prying of the carrier from the alarm tag or cutting of the pin of the carrier, or if an EAS tag receives a wireless signal from a security gate. Security gate alarms also sound if the tag moves through the gate or within a predetermined distance thereof. The carrier can remain on the purchased merchandise for subsequent disposal after removal of the alarm tag from the carrier by the use of a magnetic key to unlock a spring biased ball detent locking mechanism which engages the pin to lock the carrier to the alarm tag.

20 Claims, 8 Drawing Sheets

THEFT DETERRENT DEVICE

CROSS REFERENCE TO RELATED APPLICATIONS

This application is a continuation of U.S. patent application Ser. No. 12/183,631, filed Jul. 31, 2008, which claims priority from U.S. Provisional Application Ser. No. 60/963,225 filed Aug. 3, 2007; the disclosures of which are incorporated herein by reference.

BACKGROUND OF THE INVENTION

1. Technical Field

The invention relates to theft deterrent devices, and particularly to a device with an onboard alarm. More particularly, the invention relates to a simple device which is attached to an object, which if removed or tampered with in an unauthorized manner or passes through a security gate sounds an alarm which remains activated for a predetermined period of time.

2. Background Information

Various retail establishments use numerous types of theft deterrent devices and systems to discourage shoplifting. One common theft deterrent system uses electronic article surveillance tags (EAS) attached to the items of merchandise. These EAS tags are configured to activate an alarm at a security gate that is positioned usually at the exit of the establishment, if the merchandise containing the EAS tag passes through the secured gate before being removed or inactivated at a checkout station. Other security devices contain an internal alarm which activates an audible alarm within the device if an item of merchandise containing an EAS tag is attempted to be removed from the device illegally. Although these various security devices perform satisfactory for their intended purpose, they will only sound their self-contained alarm if tampered with in an unauthorized manner, but will not sound if the merchandise containing the security device is removed from a display until the merchandise and attached security device passes in an unauthorized manner through a security gate. This action then will actuate the security gate alarm but not the self-contained alarm of the security device attached to the merchandise. Thus, a thief can remove merchandise containing the secured EAS tag and remain undetected until passing through a store's security gate at which time an alarm will sound within the store. The thief after running through the security gate can easily disappear in a crowded parking lot or outside environment and escape with the stolen merchandise with the establishment only knowing that an article of merchandise has been removed unlawfully from the premises. These security gate alarm systems also have sensitivity problems due to the great number of EAS tags on all the different types of merchandise. This requires the security gate alarm to be activated at a particular sensitivity level and an unlawful EAS tag may not be sensed at all times.

It is also desirable to provide a security device with a configuration that is relatively simple and inexpensive to manufacture, especially where part of all of the device is intended to be left with the merchandise when removed lawfully from the store by a customer.

It is also desirable to have a device which can be attached to an article of merchandise without puncturing the merchandise and without expensive attachment means, and in particular which can be attached by a pressure sensitive adhesive, which is relatively inexpensive and which secures the device rigidly to an object being protected thereby.

It is also desirable that the expensive component of such an alarm device, namely, the electronics, switches etc. be reusable in and adapted for use with various configured objects to be protected thereby.

Thus, the need exists for an improved security device which will provide multiple alarms to assist in deterring the theft of articles of merchandise by sounding an alarm contained in the security device if the security device is removed from the article of merchandise, which will sound the self-contained alarm if the secured merchandise approaches a security gate without having been removed from the article of merchandise, and which will work in combination with a security gate of a protected establishment to sound the security gate alarm remote from the security device on the merchandise, if the protected merchandise passes through the gate in an unauthorized manner.

Furthermore, the need exists for a relatively simple and inexpensive device which provides all of the alarm features discussed above and which the more expensive components of the security device can be removed easily from the protected article at a checkout station for reuse on various types and sizes of articles.

BRIEF SUMMARY OF THE INVENTION

One aspect of the present invention is providing an electronic security device which is easily attached in a secured condition to various articles of merchandise by various types of attachment, and in particular by a pressure sensitive adhesive.

Another aspect of the invention is to provide such a security device which will sense if the integrity of one or more sense loops is compromised, which will indicate tampering or removal of the security device from the article of merchandise by sounding an alarm contained within the security device.

A further feature of the invention is to provide such a security device having a self-contained audible alarm which is actuated when the device is in proximity to a security gate or other type of detection station even when the device has not been tampered with and which remains on the article of merchandise, and which will continue to sound the alarm even upon removal of the stolen merchandise from the protected establishment.

A still further feature of the invention is to provide the security device with an EAS tag which will activate a security gate alarm system either through RF or magnetic interaction therewith, independently of the self-contained alarm in the security device.

A further aspect of the invention is to provide such a security device which has a blinking LED to provide a theft deterrent by indicating to a potential shoplifter that a security device is on the article of merchandise and is armed.

Another aspect of the invention is to provide the security device with its own self-contained power source such as a inexpensive battery, which provides a relatively long life to the device and which is protected within the device from unlawful damage or inactivation.

Still another feature of the invention is to provide a secure manner of disarming and safely removing the more expensive component of the security device from the protected merchandise, without damaging the merchandise or falsely triggering the various audible alarms for subsequent reuse.

A further aspect of the present invention provides such a device which includes an alarm tag which contains the alarm and control circuit and associated switches, which alarm tag is removable mounted on an inexpensive carrier which is adapted to be secured to an article of merchandise and can remain with the article of merchandise when removed by a customer with only the more expensive alarm tag being removed by the clerk for subsequent reuse.

Another feature of the invention is to provide such a security device that activates the alarm system only when attached to an article or object being protected thereby, thereby reducing power drain on the internal battery.

A further aspect is to form the security device of two main components, an inexpensive carrier which can be mass produced inexpensively and used as a disposable item, wherein the more expensive alarm component is removably mounted on the carrier, but in a secure state when utilized in protecting an item, but once removed at a checkout station is easily reused with another carrier thereby providing the electronic alarm features with the more expensive reusable component.

These features are obtained by the theft device of the present invention, the general nature of which may be stated of as comprising a carrier adapted to be secured to an object, the carrier having a contact member and a moveable member; an alarm tag securable to the carrier having an alarm system, a battery supplying power to the alarm system and a switch for arming the alarm system, wherein the contact member activates the alarm system when the carrier is secured to the alarm tag, and the moveable member activates an alarm switch upon securing the carrier to the object for arming the alarm system.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
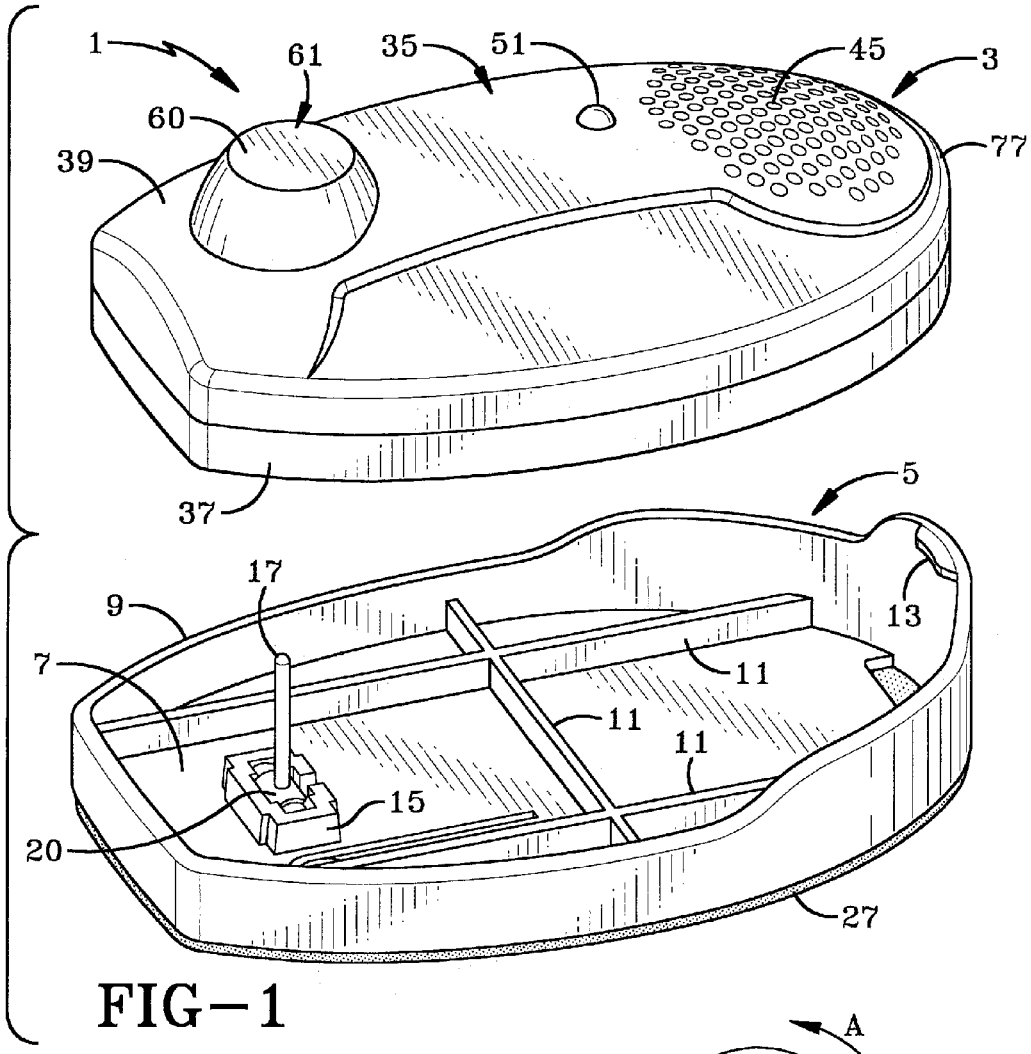
FIG. 1 is an exploded perspective view of the theft deterrent device of the present invention.
Figure 9:
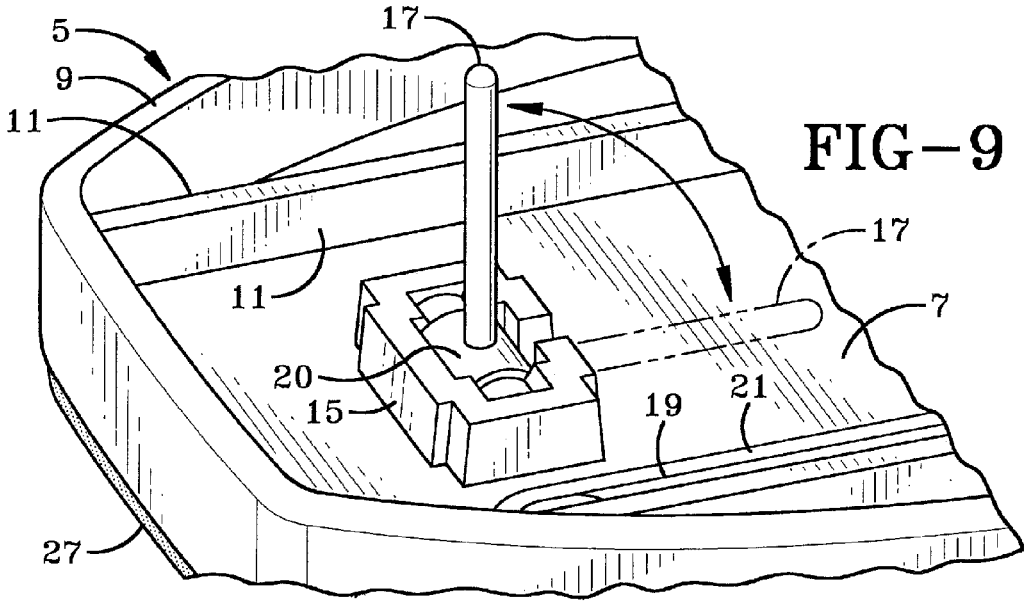
FIG. 9 is an enlarged fragmentary sectional view showing the pivotal mounting of the contact pin.

FIG. 1 is an exploded perspective view of the theft deterrent device of the present invention which is indicated generally at 1. Device 1 includes two main components, an alarm tag and a carrier indicated generally at 3 and 5 respectively. Carrier 5 has a generally oval configuration with a bottom wall 7 surrounded by an upstanding side wall 9. A plurality of reinforcing ribs 11 may be formed in and extend along the top surface of bottom wall 7. One end of side wall 9 preferably is raised higher than the opposite portion of the side wall and is formed with an inwardly extending protrusion 13, the function of which is discussed further below. A cradle 15 is mounted on the inside surface of bottom wall 7 for pivotally mounting a pin 17 therein by a cylindrical pivot 20. Pin 17 is moveable between a raised position as shown in FIGS. 1 and 9 and a retracted position as shown in dot dashed lines in FIG. 9. In the preferred embodiment, pin 17 is formed of an electrically conductive material, preferably metal.

Figure 7:
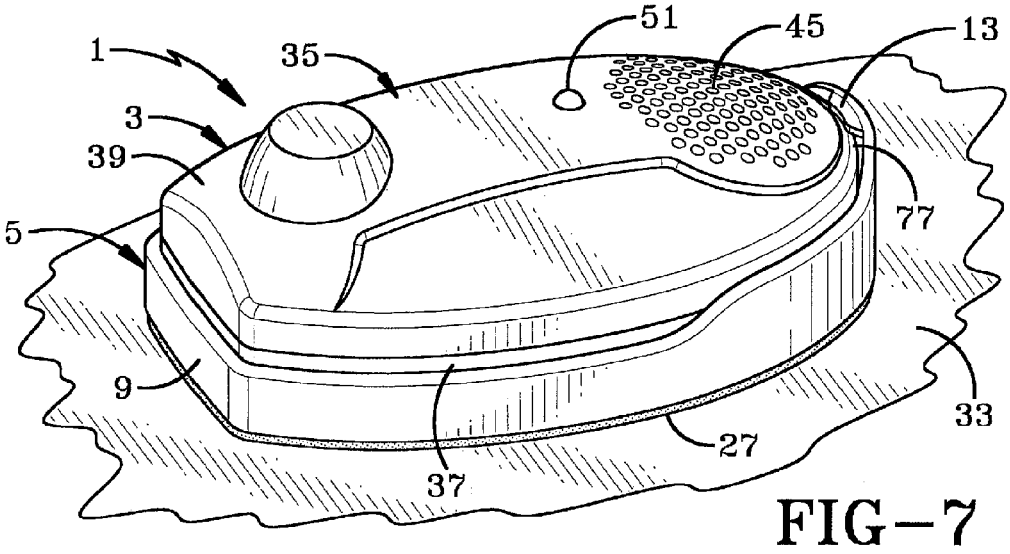
FIG. 7 is a top perspective view of the theft deterrent device shown attached to an object.
Figure 8:
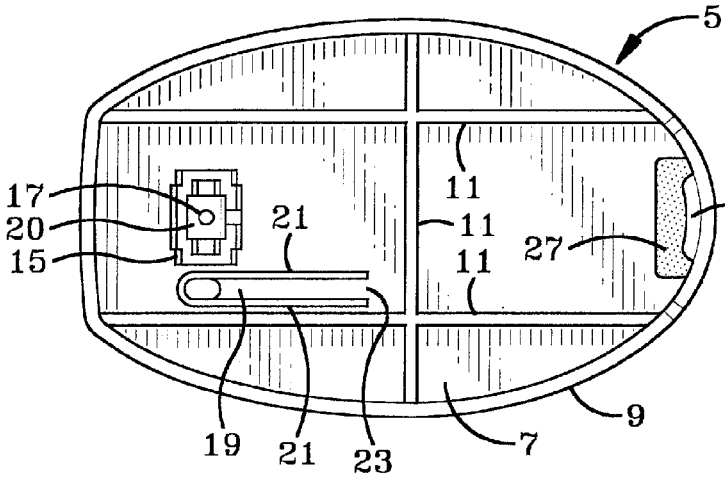
FIG. 8 is a top plan view of the carrier component of the theft deterrent device.
Figure 12:
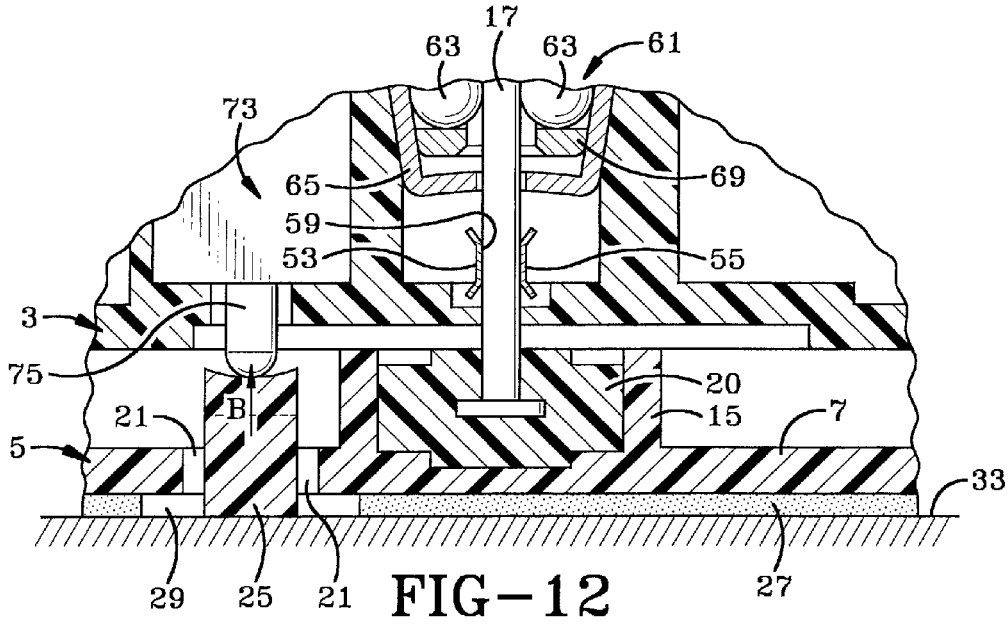
FIG. 12 is a fragmentary sectional view similar to FIG. 11 showing the theft deterrent device attached to the object.

A relatively narrow flexible strip 19 is formed in bottom wall 7 preferably of the same material by forming two slots 21 on the sides of strip 19, with strip 19 being pivotally connected to bottom wall 7 by a remaining strip of material 23. At the free end of strip 19, a projection 25 is formed which extends outwardly from the outside surface of bottom wall 7 so as to be pivotally moveable inwardly and outwardly with respect to bottom wall 7 about pivot 23 due to the flexibility of strip 19. A piece of pressure sensitive adhesive 27 preferably is mounted on the outside surface of bottom wall 7 and extends throughout the entire area thereof except for a cutout portion 29 in which is located pivot strip 19 and projection 25. Preferably a strip of release paper 31 is mounted on and extends over pressure sensitive adhesive 27 to protect the adhesive until it is removed enabling the adhesive to be used for securing carrier 5 on an object 33 as shown in FIGS. 7 and 12. Carrier 5 including the various components thereof discussed above, preferably are formed of a plastic material as an integral one piece member except for pin 17 and cylindrical pivot 20 which are separate components. Pivot 20 preferably is snap-fitted or mounted within cradle 15 by various types of mounting mechanisms providing for the pivotal movement of pivot 20 and attached pin 17.

Figure 3:
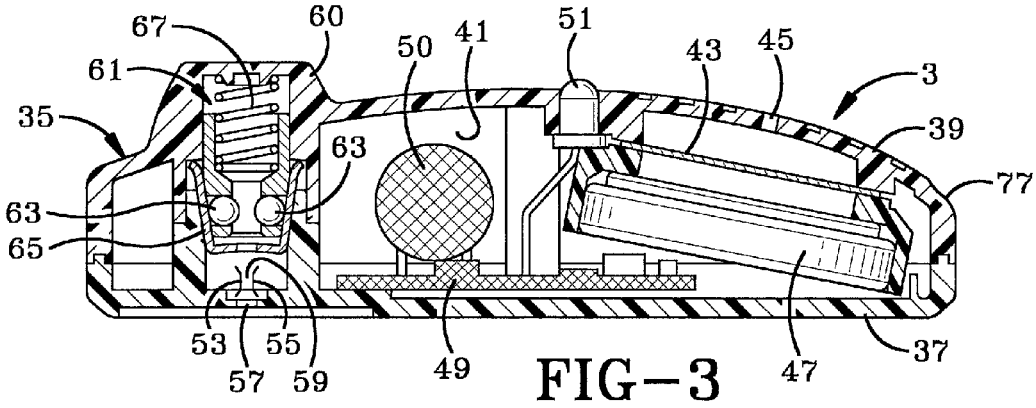
FIG. 3 is a sectional view of the alarm tag component of the theft deterrent device as shown in FIG. 1.
Figure 4:
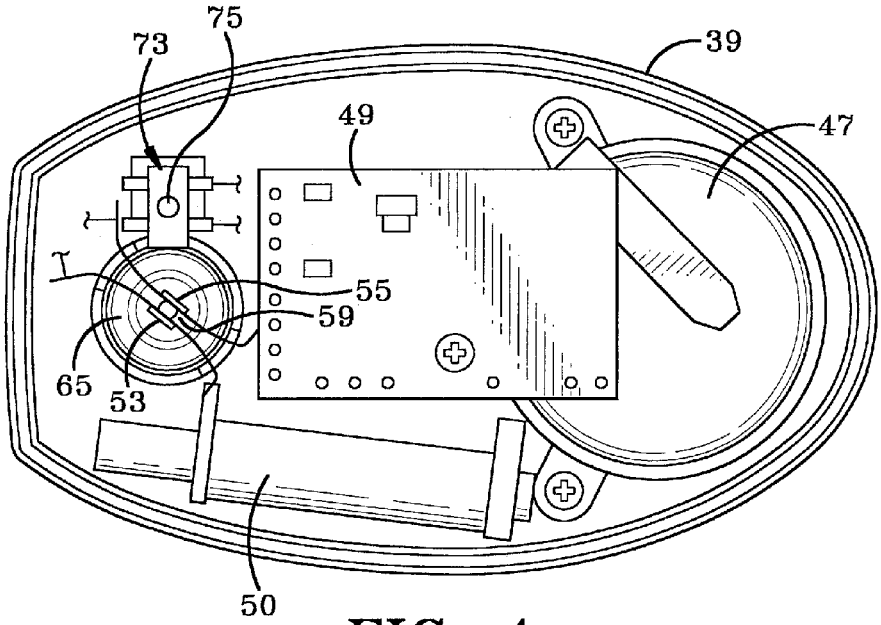
FIG. 4 is a bottom plan view of the alarm tag component of FIG. 3 with the base removed.
Figure 5:
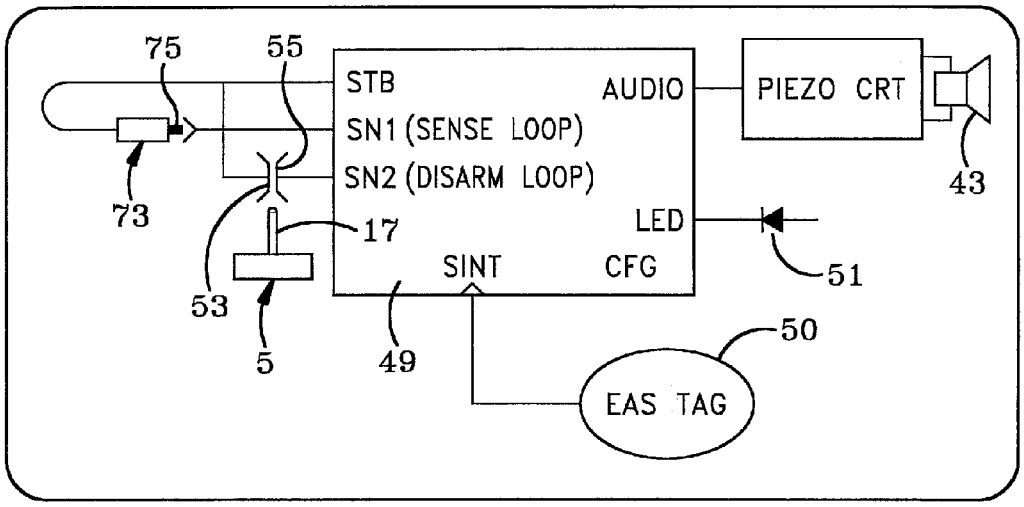
FIG. 5 is a diagrammatic view of the electrical circuitry of the theft deterrent device.

Alarm tag 3 includes a housing indicated generally at 35, which includes a base 37 and a top cover plate 39 (FIG. 3), which when assembled together by sonic welding, an adhesive or the like, forms a hollow interior 41. Alarm tag 3 preferably is similar to the alarm tag shown and described in detail in pending patent application Ser. No. 11/607,671, filed Dec. 1, 2006, and published Jul. 5, 2007 as Publication No. 2007/0152836, the contents of which are incorporated herein by reference. A piezo style speaker 43 is disposed in interior 41 adjacent a plurality of speakers holes 45 formed in top cover plate 39. Speaker 43 is configured to sound an audible alarm upon tampering with device 1 as is described further below. Speaker 43 is part of an alarm system which includes a battery 47 which is also located within interior 41, for providing the power to the alarm system. The alarm system further includes a printed circuit board (PCB) 49 and a visual alarm indicator 51 such as an LED, which is mounted within interior 41 and extends through a hole in top cover plate 39 so that a portion of the LED is visible from a position external to device 1. LED 51 is typically configured to produce a blinking light when device 1 is an armed state. This warns a potential thief that the item of merchandise is protected by a theft deterrent device to assist in preventing even a theft attempt. First and second electrical contacts 53 and 55 (FIG. 10) are spaced from one another adjacent a pin-receiving opening 57 formed in base 37 and define a space 59 therebetween which is aligned with opening 57 which are configured to receive pin 17 of carrier 5 when alarm tag 3 is secured to carrier 5.

Figure 13:
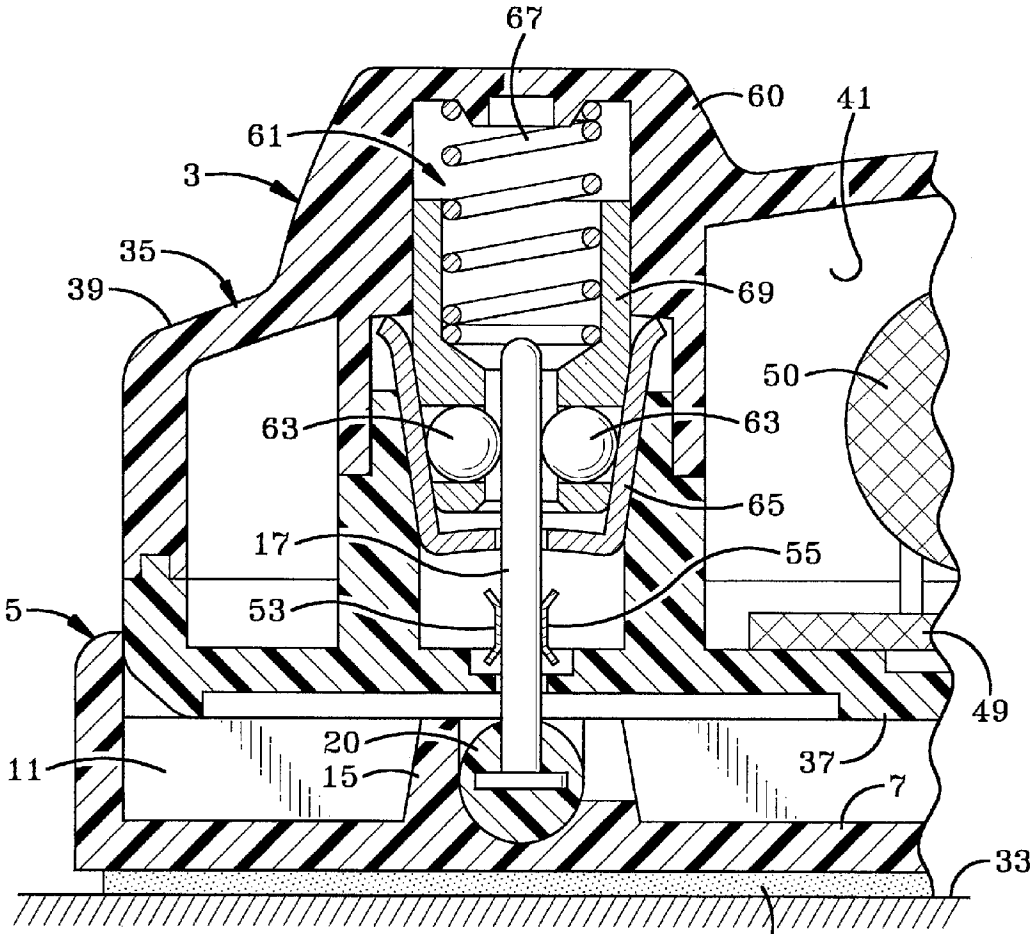
FIG. 13 is a fragmentary sectional view similar to FIG. 12 showing the theft deterrent device attached to an object.
Figure 15:
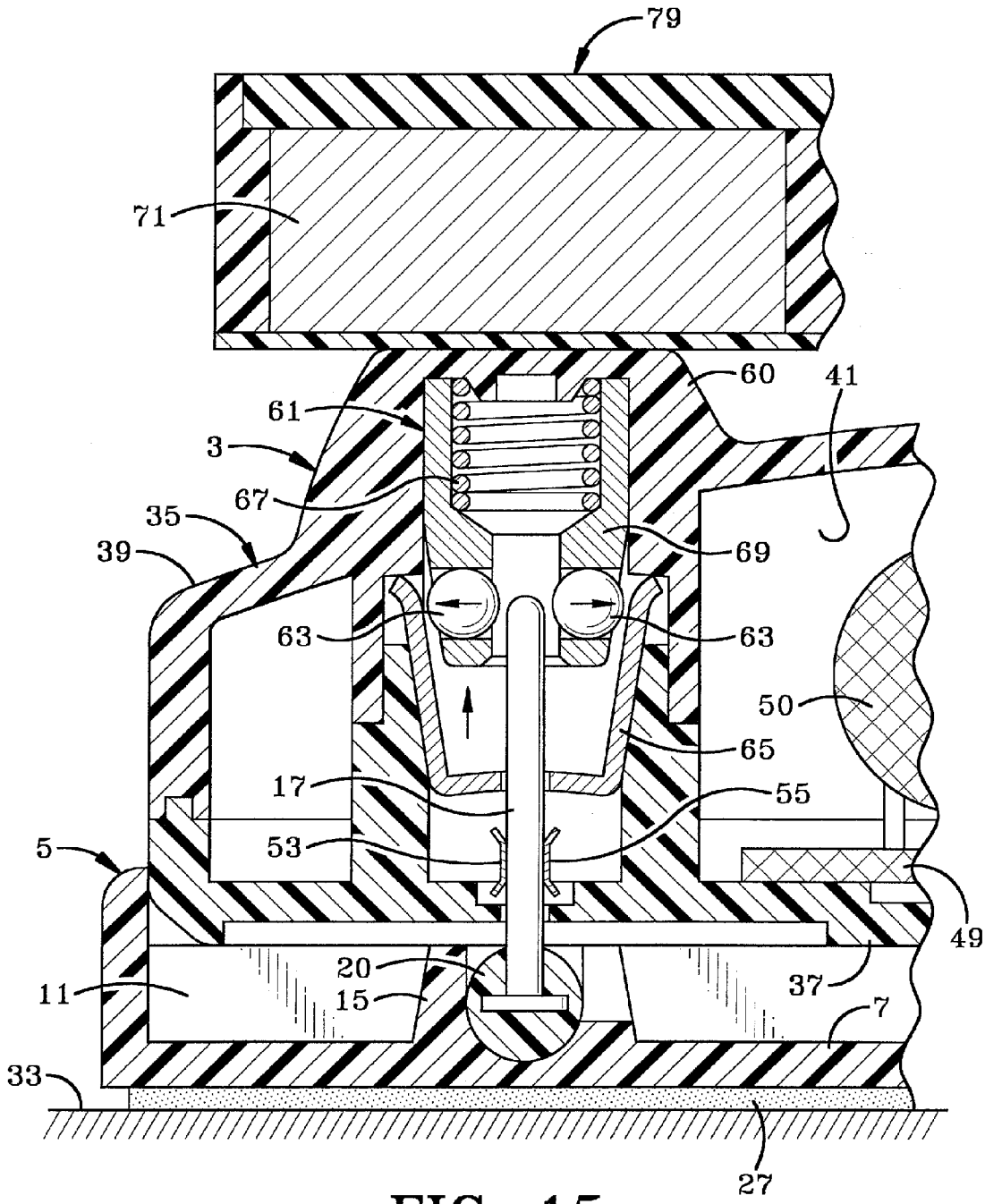
FIG. 15 is a fragmentary sectional view similar to FIG. 13 showing a magnetic key moving the locking mechanism to the unlocked position.

A locking mechanism indicated generally at 61, is located within alarm tag 3 and is in the form of spring biased ball detent mechanism which engages pin 17 to assist in securing alarm tag 3 in carrier 5 as shown particularly in FIG. 13. Locking mechanism 61 includes a pair of locking balls 63 mounted within a tapered cup 65 and trapped in a shuttle 69. Shuttle 69 is spring biased downwardly by a coil spring 67 which is located in a dome-shaped portion 60 of cover plate 39. Shuttle 69 is formed of a magnetically attractable material such as a metal, for unlocking lock mechanism 63 from pin 17 when a magnet 71 of a magnetic key 79 (FIG. 15) is placed on dome-shaped portion 60 adjacent to shuttle 69. Magnet 71 attracts the shuttle and trapped balls 63 and moves them in an upward direction releasing the locking engagement between balls 63 and pin 17 as shown in FIG. 15. This enables alarm tag 3, which is the more expensive component of the security device, to be easily removed from carrier 5 for reuse with the same or other carriers.

Figure 10:
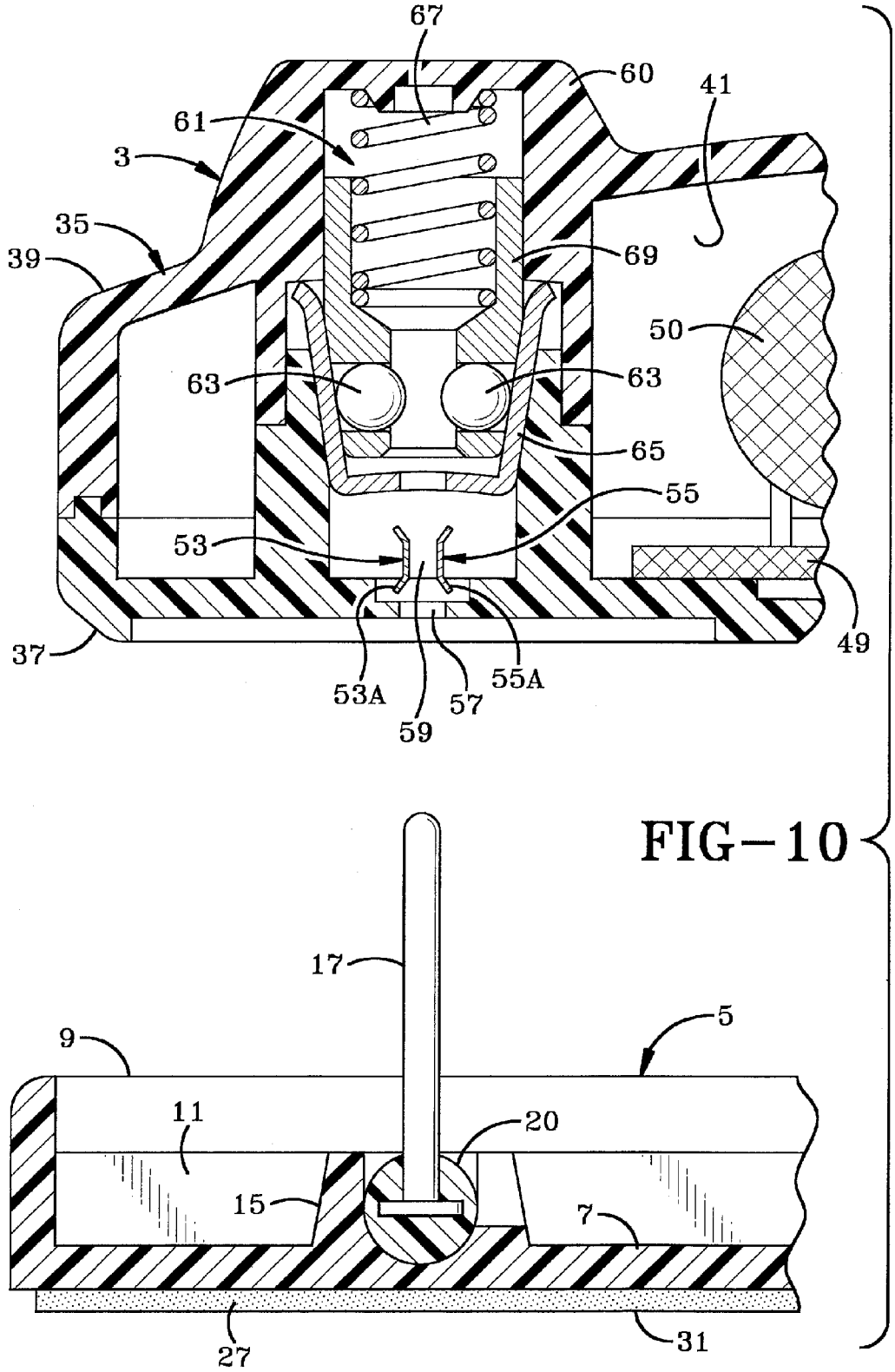
FIG. 10 is a fragmentary sectional view showing the electrical contacts and spring biased ball detent locking mechanism of the alarm tag prior to the insertion of the carrier pin therein.
Figure 11:
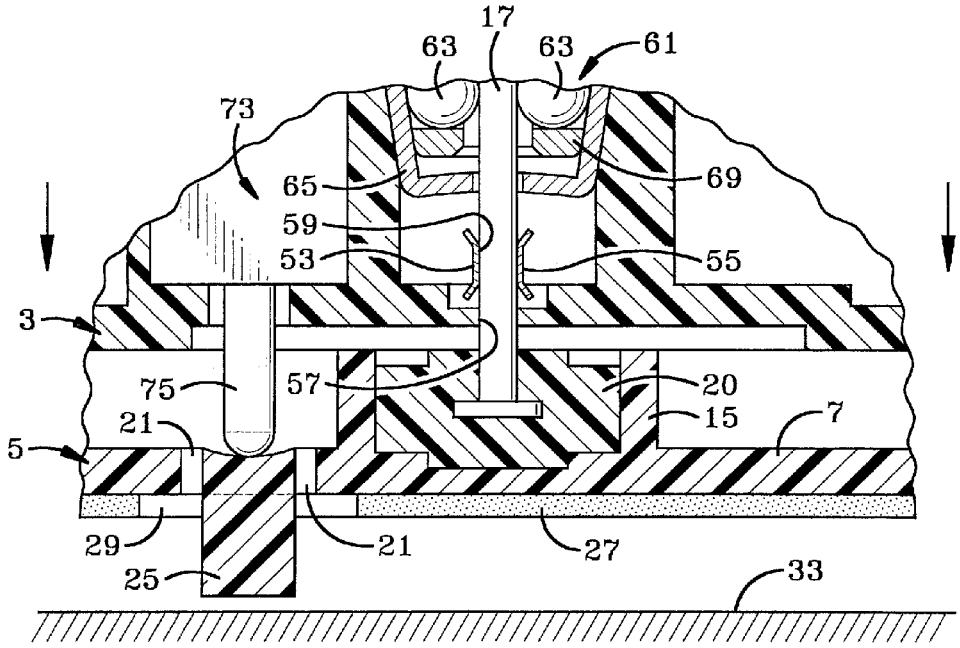
FIG. 11 is an enlarged fragmentary sectional view showing the carrier pin and alarm tag in assembled position prior to being attached to an object.
Figure 14:
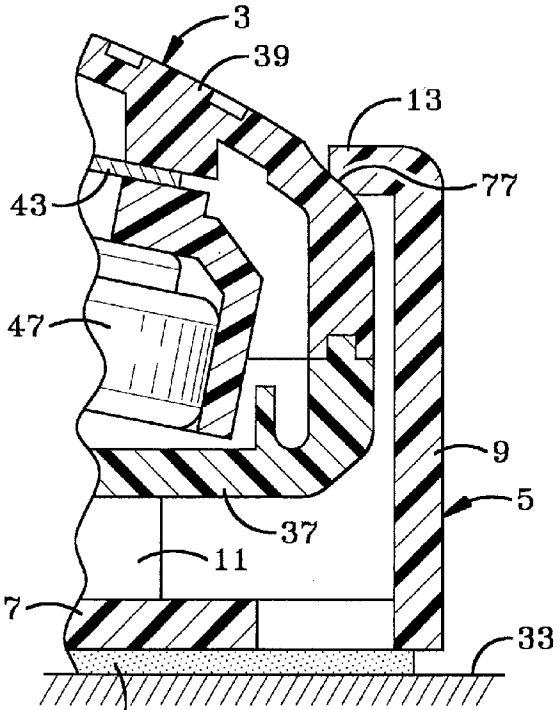
FIG. 14 is an enlarged fragmentary sectional view showing the attachment of the alarm tag and the carrier.

Referring particularly to FIG. 10, electrical contacts 53 and 55 preferably are resilient members formed of spring steel or the like and are each formed of a generally flat strip of spring metal which is generally configured in a shallow U-shape so that the base of each U-shaped member is adjacent one another with each U-shaped member opening away from one another. The resilient nature of members 53 and 55 allow them to flex away from and towards one another in response to the insertion and removal of pin 17 into and from space 59. Contacts 53 and 55 include lower flanges 53A and 55A which taper outwardly and downwardly to facilitate insertion of pin 17 into space 59. The alarm system also includes a plunger switch 73 which has a plunger 75 that is movable between an extended non-compressed position as shown in FIG. 11 to a depressed position as shown in FIG. 12, which when depressed will activate the alarm circuitry. When alarm tag 3 is secured in carrier 5, plunger 75 aligns with and abuts projection 25 (FIG. 11), but without sufficient pressure to depress plunger 75 and activate switch 73. Thus, when alarm tag 3 is secured to carrier 5 by end protrusion 13 engaging a shoulder 77 formed on top cover plate 39 as shown in FIG. 14, and with lock mechanism 61 engaging pin 17, plunger switch 73 is not activated as shown in FIG. 11, until the security device is secured to an object 13 as shown in FIG. 12.

Figure 2:
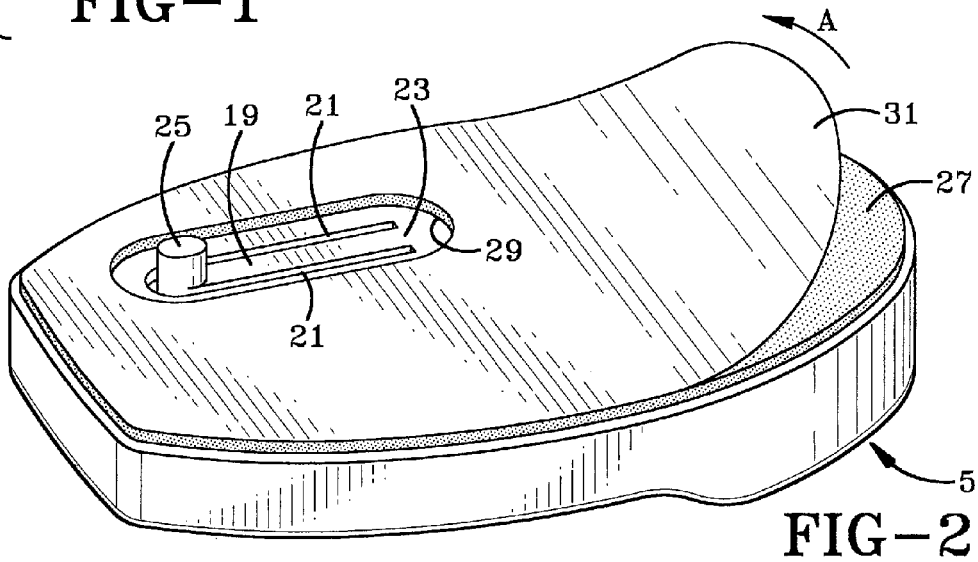
FIG. 2 is a bottom plan view of the carrier component of the theft deterrent device of FIG. 1.

The operation of device 1 is as follows. As indicated above, alarm tag 3 is placed within sidewall 9 of carrier 5 and is seated upon ribs 11 and is attached to carrier 5 and retained therein by protrusion 13 engaging shoulder 77 of alarm tag 3, and pin 17 being secured by locking mechanism 61. Pin 17 is electrically conductive and thus completes an electric circuit or sense loop between contacts 53 and 55 to cause battery 47 to power PCB 49 and the rest of the alarm system. The completion of the circuit or sense loop occurs upon the first contact of pin 17 with contacts 53 and 55. As pin 17 is fully inserted, balls 63 lockably engage pin 17 securing alarm tag 3 to carrier 5, as well as completing the electric circuit between contacts 53 and 55 through pin 17. The resilient force of contacts 53 and 55 ensures that this electrical contact is maintained when alarm tag 3 is secured in carrier 5. However, until security device 1 is attached to object 33 and plunger switch 73 is depressed, the alarm circuit is not fully functional. Release paper 31 is removed as shown by Arrow A in FIG. 2, exposing pressure sensitive adhesive 27 which is pressed against the object as shown in FIGS. 11 and 12, securely attaching device 1 to object 33. When this occurs, projection 25 moves upwardly in the direction of Arrow B (FIG. 12), depressing plunger 75 which actuates switch 73 which arms the circuit and activates alarm indicator (LED) 51, as well as powering up the printed circuit board 49 placing the alarm in its operational active state.

Should a thief physically pull the assembled device 1 from object 33, plunger switch 75 will move from its depressed position of FIG. 12 to its extended position of FIG. 11 due to the spring bias of flexible strip 19, sounding the piezo alarm to alert store personnel. Likewise, if a thief would attempt to separate alarm tag 3 from carrier 5, depressed plunger 75 will move to its extended non-compressed position also causing the alarm to sound. Such an unauthorized removal also disconnects the electrical circuit between contacts 53 and 55 causing the audible alarm to be actuated.

Figure 6:
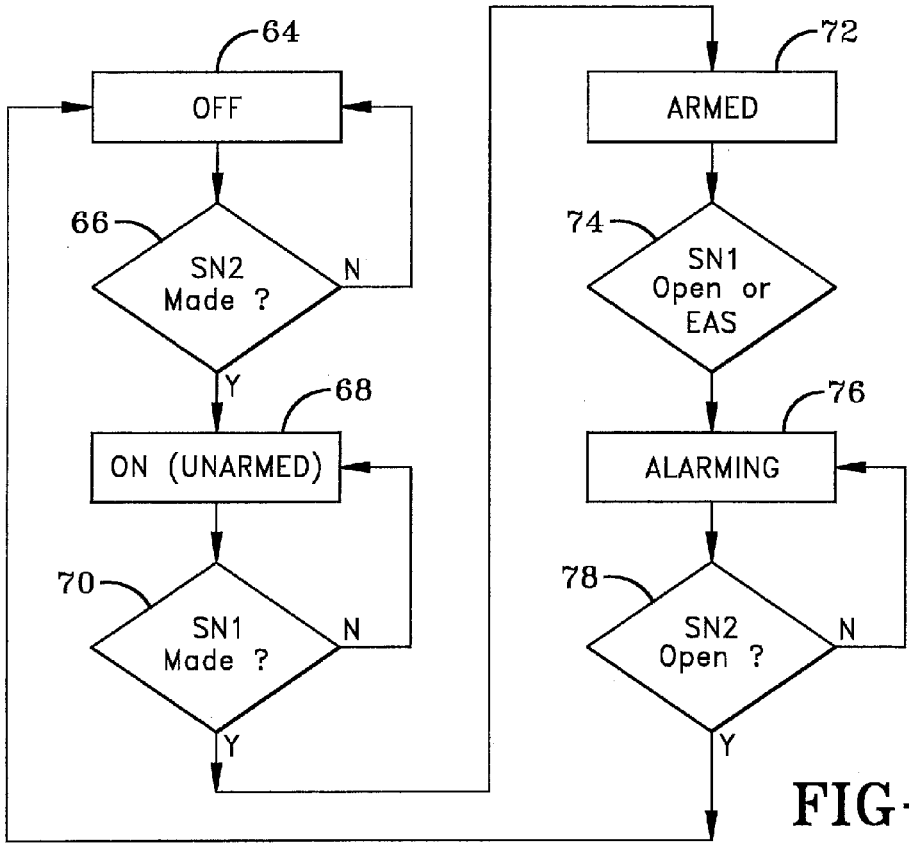
FIG. 6 is a flow chart showing the arming and disarming sequence of the theft deterrent device.

Referring to FIG. 6, the electrical circuitry of the alarm system is further described. When alarm tag 3 and carrier 5 are removed from one another so that pin 17 is not completing the electrical circuit between contacts 53 and 55, device 1 is in a standby or off state. Battery 47 will typically send a pulsing signal to check whether the electrical circuits have been completed upon insertion of pin 17 into alarm tag 3. More particularly, the alarm system includes a sense loop SN1, which includes plunger switch 73 and a disarm loop or on/off loop SN2 which includes contacts 53 and 55.

Device 1 is in the off state as indicated at 64 when alarm tag 3 and carrier 5 are separated from one another, and more particularly when pin 17 is not in contact with contacts 53 and 55 to complete loop SN2. PCB 49 includes a logic circuit for checking to determine whether loop SN2 has been completed or not as indicated at 66. If not, device 1 remains in the off state. If loop SN2 has been completed by the insertion of pin 17 into contact with contacts 53 and 55, PCB 49 senses the closing of loop SN2 so that device 1 has been turned on, although it is unarmed at this initial state indicated at 68. PCB 49 then checks to see if sense loop SN1 has been completed as indicated at 70. If not, device 1 remains on but unarmed. If loop SN1 has been completed by the depression of plunger 75, device 1 is in the armed state as indicated at 72.

Once in the armed state, PCB 49 checks to see whether loop SN1 is opened or whether EAS tag 50 has received a wireless signal from a security gate due to device 1 passing through the security gate or within a predetermined distance from the security gate as indicated at 74. If any of these three conditions occur, device 1 will sound an alarm via speaker 43 as indicated at 76. This onboard alarm is configured to continue sounding for a specific period of time, for example, ten minutes, so that even if a potential thief escapes from the store, the alarm will continue sounding in an adjacent area such as parking lots and the like. PCB 49 determines whether loop SN2 is open as indicated at 78, if not, the alarm continues to sound. If SN2 is open, then device 1 will return to its off state as indicated at 64. Thus, when sense loop SN2 has been opened due to prying or the cutting of pin 17 so that plunger 75 moves to its non-depressed position, device 1 will continue to sound an alarm unless pin 17 is removed from space 59 out of contact with contacts 53 and 55 in order to open loop SN2. This may be done by store personnel with the appropriate magnetic key 79.

Thus, security device 1 provides a device containing and providing the various alarm features discussed above wherein the more expensive component containing the alarm circuitry, switches, PCB etc. is reusable with the less expensive carrier 5 being disposable. Also, carrier 5 can be attached to various sizes and shapes of objects and items of merchandise by the pressure sensitive adhesive and remain on the object for throw away after purchase. Carrier 5 also eliminates the need to puncture the protected article as required with tack security devices. Also, alarm tag 3 is identical to the alarm tag used with a pin, such as disclosed in the previously identified pending patent application Ser. No. 11/607,671 and thus is able to provide the desired security for an article of merchandise whether used with a tack that passes through the merchandise or with carrier 5 that is attached to the merchandise with pressure sensitive adhesive. Whether used with a tack as shown in said pending application Ser. No. 11/607,671 or with pin 17, both will complete the electrical circuit between the spaced spring contacts and are secured in a locked position by the spring biased ball detent mechanism. The pivotal mounting of the pin on the carrier enables the pin to be moved relatively flush with the carrier bottom wall when removed from the alarm tag to prevent breakage or injury to individuals.

It is readily understood that carrier pin 17 can be replaced with other types of switch actuating members and need not be a pivotally mounted metallic pin so long as such a member is provided on the carrier which actuates the alarm switch located within alarm tag 3 when attached thereto. For example, pin 17 could be replaced with another type of switch actuating member which actuates an alarm switch, such as a plunger switch to activate or arm the alarm system when tag 3 is secured to carrier 5. In the preferred embodiment, metallic pin 17 provides electrical contact between contacts 53 and 55, as described above and shown in the drawings. Furthermore, carrier 5 can be attached to a package with other types of securement device, such as a banding strap, cable, etc., and need not require a pressure sensitive adhesive, without departing from the concept of the present invention. Furthermore, alarm tag 3 can be secured to carrier 5 by various types of attachments which when brought to an authorized checkout facility enables tag 3 to be removed easily from carrier 5 for subsequent reuse with another carrier.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of protecting an item of merchandise including the steps of:

attaching a carrier to the item of merchandise;

moving a contact mounted on the carrier to an upwardly projecting position from the carrier;

releasably locking an alarm tag containing an alarm system to the upwardly projecting contact of the carrier;

arming the alarm system permitting the item of merchandise to be displayed and handled by a perspective purchaser;

unlocking and removing the alarm tag from the carrier by an authorized personnel automatically disarming the alarm system;

retaining the alarm tag after removal for subsequent reuse with another carrier; and permitting the carrier to remain on the item of merchandise for subsequent disposal by the purchaser.

2. The method defined in claim 1 including the step of inserting the upstanding contact into the alarm tag which locks the alarm tag to the carrier and arms the alarm system.

3. The method defined in claim 1 including the step of automatically arming the alarm system upon releasably locking the alarm tag to the carrier.

4. The method defined in claim 1 including the step of actuating a plunger switch on the alarm tag upon attaching the carrier to the item of merchandise to arm the alarm system.

5. The method defined in claim 4 including the steps of providing a flexible strip on the carrier; and moving the flexible strip into contact with the plunger switch on the alarm tag when attaching the carrier on the item of merchandise.

6. The method defined in claim 1 including the step of attaching the carrier to the item of merchandise by a pressure sensitive adhesive.

7. The method defined in claim 1 including the steps of inserting the contact extending upwardly from the carrier into a lock mechanism in the alarm tag; and providing the lock mechanism with a ball detent mechanism which engages the contact to lock the carrier to the alarm tag.

8. The method defined in claim 7 including the steps of providing the lock mechanism with a magnetically attractable shuttle; and magnetically attracting the shuttle to unlock the lock mechanism enabling the alarm tag to be removed from the carrier.

9. The method defined in claim 1 including the step of actuating an audible alarm contained in the alarm system upon removing the carrier from the item of merchandise when the alarm tag is armed and locked on the carrier.

10. The method defined in claim 1 including the step of attaching the carrier to the item of merchandise without piercing the merchandise.

11. The method defined in claim 1 including the steps of forming the contact as a locking pin of an electrical conductive material; and inserting the pin between a pair of spaced electrical contacts in the alarm tag to complete an electric circuit when the alarm tag is secured to the carrier.

12. The method defined in claim 1 including the step of providing a visual alarm indicator on the alarm system; and activating said alarm indicator when arming the alarm system.

13. A method of protecting an item of merchandise including the steps of:

attaching a first locking member to the item of merchandise;

securing a second locking member containing an alarming device to the first locking member permitting the item to be displayed and transported by a customer to a checkout location by engaging a locking pin on the first locking member with a locking mechanism contained in the second locking member wherein the locking pin is movable between a raised position and a retracted position;

providing the first locking member as a less expensive member than the second locking member;

providing the lock mechanism with a magnetically attractable shuttle;

magnetically attracting the shuttle to unlock the lock mechanism enabling the second locking member to be removed from the first locking member;

removing the second locking member from the first locking member by an authorized personnel at the checkout location prior to moving the item of merchandise past a security gate;

permitting the first locking member to remain on the item of merchandise for subsequent disposal by a purchaser of the item of merchandise; and retaining the second locking member for subsequent reuse with another first locking member on another item of merchandise.

14. The method defined in claim 13 including the step of providing the alarming device with an audible alarm and sounding said alarm upon unauthorized removal of the first and/or second locking members from the item of merchandise.

15. A method of protecting an item of merchandise including the steps of:

attaching a first locking member to the item of merchandise;

securing a second locking member containing an alarming device to the first locking member permitting the item to be displayed and transported by a customer to a checkout location by engaging a locking pin on the first locking member with a locking mechanism contained in the second locking member;

pivotally moving the locking pin from a retracted position within the first locking member to an upwardly raised position projecting from the first locking member before securing the second locking member on said first locking member, providing the first locking member as a less expensive member than the second locking member;

removing the second locking member from the first locking member by an authorized personnel at the checkout location prior to moving the item of merchandise past a security gate;

permitting the first locking member to remain on the item of merchandise for subsequent disposal by a purchaser of the item of merchandise; and retaining the second locking member for subsequent reuse with another first locking member on another item of merchandise.

16. The method defined in claim 13 including forming the first locking member of a plastic material with a bottom wall and upstanding side walls;

providing the second locking member with a housing having a hollow interior; and securing the alarming device within the hollow interior of the housing.

17. The method defined in claim 13 wherein the first locking member is attached to the item of merchandise without piercing said item of merchandise.

18. A method of protecting an item of merchandise including the steps of:

attaching a carrier to the item of merchandise;

releasably locking an alarm tag containing an alarm system to the carrier;

arming the alarm system permitting the item of merchandise to be displayed and handled by a perspective purchaser;

providing a flexible strip on the carrier and moving the flexible strip into contact with a plunger switch on the alarm tag when attaching the carrier on the item of merchandise;

unlocking and removing the alarm tag from the carrier by an authorized personnel automatically disarming the alarm system;

retaining the alarm tag after removal for subsequent reuse with another carrier; and permitting the carrier to remain on the item of merchandise for subsequent disposal by the purchaser.

19. A method of protecting an item of merchandise including the steps of:

attaching a carrier to the item of merchandise;

releasably locking an alarm tag containing an alarm system to the carrier;

providing a locking pin on the carrier of an electrical conductive material;

inserting the pin between a pair of spaced electrical contacts in the alarm tag to complete an electric circuit when the alarm tag is secured to the carrier to arm the alarm system permitting the item of merchandise to be displayed and handled by a perspective purchaser;

unlocking and removing the alarm tag from the carrier by an authorized personnel automatically disarming the alarm system;

retaining the alarm tag after removal for subsequent reuse with another carrier; and permitting the carrier to remain on the item of merchandise for subsequent disposal by the purchaser.

20. The method defined in claim 19 including the steps of providing the lock mechanism with a magnetically attractable shuttle; and magnetically attracting the shuttle to unlock the lock mechanism enabling the second locking member to be removed from the first locking member.

* * * * *